US006300583B1

(12) United States Patent
Hsu

(10) Patent No.: US 6,300,583 B1
(45) Date of Patent: Oct. 9, 2001

(54) COLLAPSIBLE KEY STRUCTURE WITH SCISSORS TYPE LINKAGE

(75) Inventor: Chien-Shih Hsu, Taipei (TW)

(73) Assignee: Darfon Electronics Corp., TaoYuan (TW)

( * ) Notice: Subject to any disclaimer, the term of this patent is extended or adjusted under 35 U.S.C. 154(b) by 0 days.

(21) Appl. No.: 09/734,907

(22) Filed: Dec. 13, 2000

(30) Foreign Application Priority Data

Jan. 31, 2000 (TW) ..... 89201685

(51) Int. Cl.[7] ..... H01H 3/12
(52) U.S. Cl. ..... 200/344
(58) Field of Search ..... 200/341, 344, 200/518–520, 252, 329, 337

(56) References Cited

U.S. PATENT DOCUMENTS 4,580,022 * 4/1986 Oelsch et al. ..... 200/340
4,902,862 * 2/1990 Oelsch et al. ..... 200/340
6,183,150 * 2/2001 Kao ..... 400/495

* cited by examiner

*Primary Examiner*—Paula Bradley
*Assistant Examiner*—Nhung Nguyen
(74) *Attorney, Agent, or Firm*—Dougherty & Troxell

(57) ABSTRACT

A collapsible key structure for a depression key structure includes a pair of scissors type linkage for supporting the depression key structure. At least one scissors type linkage has a first lever pivotally engaged with a second lever. The first lever has a top end pivotally engaged with depression key structure and a bottom end rotatably and slidably engaged with a base plate. The second lever has a top end rotatably and slidably engaged with the depression key structure and a bottom end forming a rotatable-and-slidable constraint means with the base plate. The rotatable-and-slidable constraint means includes a bordering rail mounted on the base plate, in which the bordering rail has a first and a second sliding surfaces for a first and a second engaging pins at a bottom end of the second lever to slide along, respectively. By providing the present invention, the depression key structure may be moved steadily up or down without drifting sideward. Also, assembly and disassembly of the collapsible key structure can be performed simpler and without much deforming the first and the second levers.

7 Claims, 5 Drawing Sheets

COLLAPSIBLE KEY STRUCTURE WITH SCISSORS TYPE LINKAGE

FIELD OF THE INVENTION

This invention relates to a novel collapsible key structure and more particularly to an improved scissors type linkage for the depression key structure to be operated steadily and be assembled easily.

BACKGROUND OF THE INVENTION

In conventional notebook computers, the depression key structure in a keyboard is usually supported by a collapsible mechanism and a rubber. FIG. 1 shows a typical depression key structure mounted on a base plate 10. The depression key structure 1 has a key top 11 for receiving external force and a scissors type linkage 12 which has pairs of symmetrical levers to support the depression key structure 1 and to enable the depression key structure 1 being lifted upward or pressed downward. As shown, there is a hollow rubber body 13 located under the depression key structure 1 and between the levers to provide spring energy for lifting the depression key structure 1 after the depression key structure 1 being pressed downward. The touch control circuit for the depression key structure 1 is located on the base plate 10 and under the rubber body 13 (not shown in the figure).

In the following description, only the depression key structure 1 and the collapsible linkage 12 will be shown in the figures and text. The rubber body 13 and touch control circuit will be omitted. Similar components will be marked by similar numerals any way, no matter whether or not they are in the prior arts or belong to this invention.

FIG. 2 shows a conventional collapsible mechanism 12 for the depression key structure 1. It is located between a bottom side 110 of the key top 11 and the base plate 10. It has a first lever 121 crossly engaged with a second lever 122 at a pivotal point 123 to form a substantially scissors type linkage. Two sets of such lever linkage are disposed at opposing sides under the key top 11. The first lever 121 has a first top end 1211 pivotally engaged with a first hub 1101 located under the bottom side 110 and a first bottom end 1212 rotatably and slidably engaged with a third hub 101 located on the base plate 10. The second lever 122 has a second top end 1221 pivotally and slidably engaged with a second L-shaped flange 1102 located below the bottom side 110 and a second bottom end 1222 pivotally engaged with a fourth hub 102 located on the base plate 10. The first and the second levers 121 and 122 thus form a scissors type linkage 12 that may be moved up or down under external force. The first hub 1101 and fourth hub 102 are located fixedly on a vertical dot line L.

When the key top 11 of the depression key structure 1 subjects to a downward or uplift pressure, the first top end 1211 and the second bottom end 1222 can move pivotally respectively in the first and fourth hub 1101 and 102, while the second top end 1221 and first bottom end 1212 are rotational and slidable respectively on the second flange 1102 and third hub 101. Although this structure may allow the depression key structure 1 to be lifted or lowered steadily, yet it is difficult to be manufactured and assembled. In addition, well performance of the vertical alignment of the first hub 1101 and the fourth hub 102 needs good precision in assembly. Or, a small deviation upon such alignment will create a substantial amount of lever deformation and thus make hard to fit the first top end 1211 and the second bottom end 1222 into the hubs 1101 and 102, respectively.

Furthermore, as the notebook computer is small sized and the lever 121 and 122 are generally made by plastics in thin and elongating shapes, the deformation under any possible external force during assembly could often break or rupture the levers, particularly at the force concentration points thereof at both ends of the lever or in the middle pivotal point thereof. Inevitably, such a disadvantage will drag down the production efficiency as well as the yield of the keyboard. Also, assembly and disassembly related to the depression key structure of a notebook computer is difficult. Moreover, repairs and maintenance work of such key structure are definitely time consuming.

FIG. 3 shows another conventional collapsible mechanism for depression key structure. Comparing with the one shown in FIG. 2, the main differences in between are the engagement styles for the first top end 1211 and the second bottom end 1222. A L-shaped first flange 1101 replaces the hub and a rotatable and slidable fourth hub 102 are used to replace the hub used in FIG. 2. Thus, all four ends of the fist and the second levers 121 and 122 are rotatable and slidable. As shown in this embodiment, there is no fixed vertical line alignment needed. Assembly and disassembly is also easier, by comparing with the aforesaid structure. Deformation of the levers is believed to be less severe and may reduce the possibility of breaking or rupture upon the levers.

However, due to no need of the fixed vertical line alignment upon the respective pivotal point, the levers could then move sideward. The up and down motion of the depression key structure 1 is thus less stable. Therefore, how to get a supporting mechanism of the depression key structure that enables the depression key structure 1 to move up or down steadily and may be assembled or disassembled easily is still an issue begging for improvement.

SUMMARY OF THE INVENTION

It is an object of this invention to provide a novel collapsible mechanism for a depression key structure that may offer steady operation of the depression key structure and may also be assembled and disassembled easily.

It is another object of this invention to provide a collapsible mechanism that offers a rotatable and slidable constraint means for the levers so that the depression key structure may be moved up or down steadily and controllably without drifting sideward.

The collapsible mechanism of this invention includes a key top, a base plate and a scissors type linkage to support the key top for up and down movement above the base plate. The scissors type linkage has a first lever pivotally engaged with a second lever at a middle pivotal point. The first lever has a first top end pivotally engaging with a first hub located under the key top and a first bottom end rotatable and slidable in a third hub located on the base plate. The second lever has a second top end rotatable and slidable in an L-shape flange located under the key top and a second bottom end rotatable and slidable in a rotatable and slidable constraint means.

The rotatable and slidable constraint means includes a bordering rail mounted on the base plate, and a first engaging pin and a second engaging pin located at the second bottom end. The bordering rail has a horizontal first sliding surface distant from the pivotal point for the first engaging pin to slide thereon, and a vertical second sliding surface facing the pivotal point for the second engaging pin to slide thereon.

Two pairs of symmetrical scissors type levers are used to support a depression key structure.

The bordering rail may be a "L"-shaped member with the first sliding surface being flat, smooth and horizontally located under the horizontal flange facing the base plate and the second sliding surface being smooth and vertically located at a lateral side facing the pivotal point.

In another aspect of the present invention, the bordering rail may be a rectangular member mounted on the base plate with a vertical smooth outward side wall serving as the second sliding surface and a horizontal smooth bottom surface under the top wall serving as the first slide surface.

According to the present invention, the second sliding surface may have a curvature or be a flat surface (with an infinite curvature).

In yet another aspect of the present invention, a third sliding surface may be formed on base plate surface to couple with the second sliding surface for limiting the moving path of the first engaging pin.

BRIEF DESCRIPTION OF THE DRAWINGS

The invention, as well as its many advantages, may be further understood by the following detailed description and drawings in-which.

DETAILED DESCRIPTION OF THE PREFERRED EMBODIMENT

Figure 1:
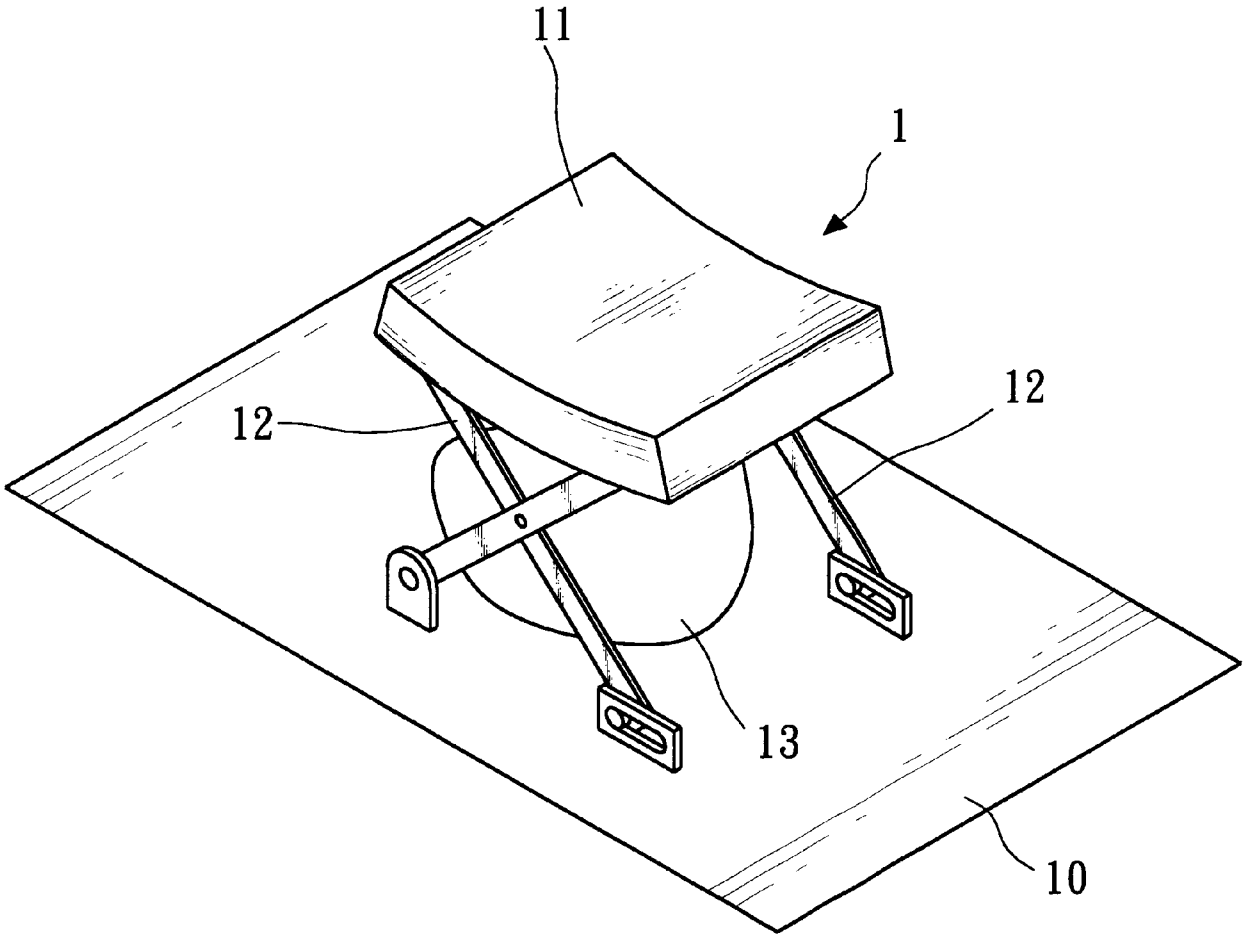
FIG. 1 (PRIOR ART)
FIG. 1 is a perspective view of a conventional collapsible key structure.
Figure 2:
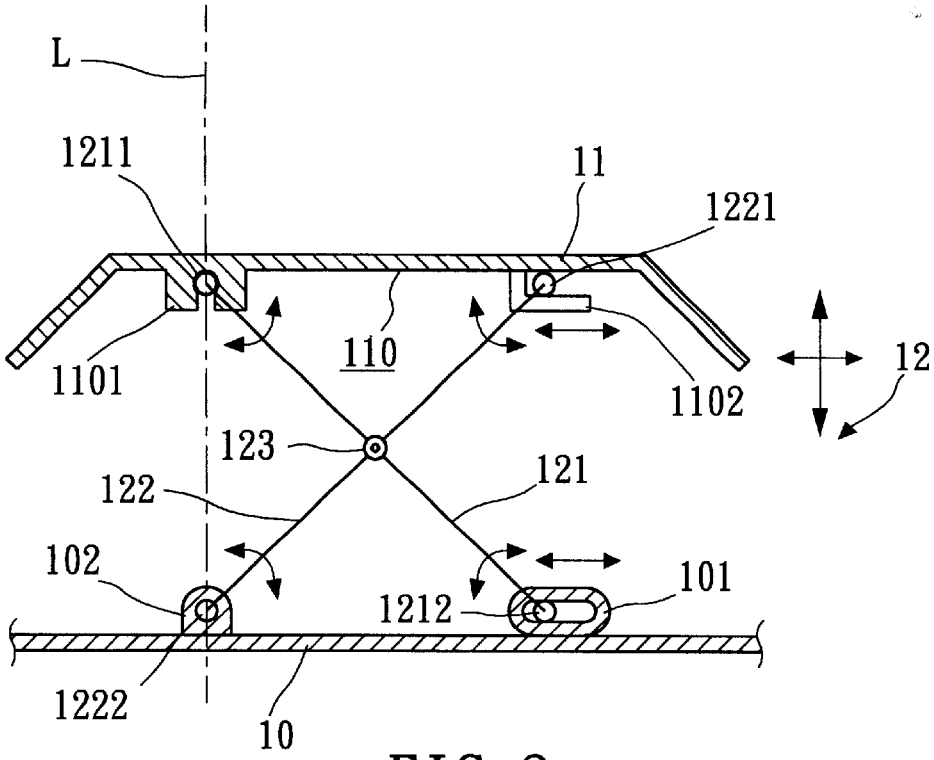
FIG. 2 (PRIOR ART)
FIG. 2 is a schematic side view of another conventional collapsible key structure.
Figure 3:
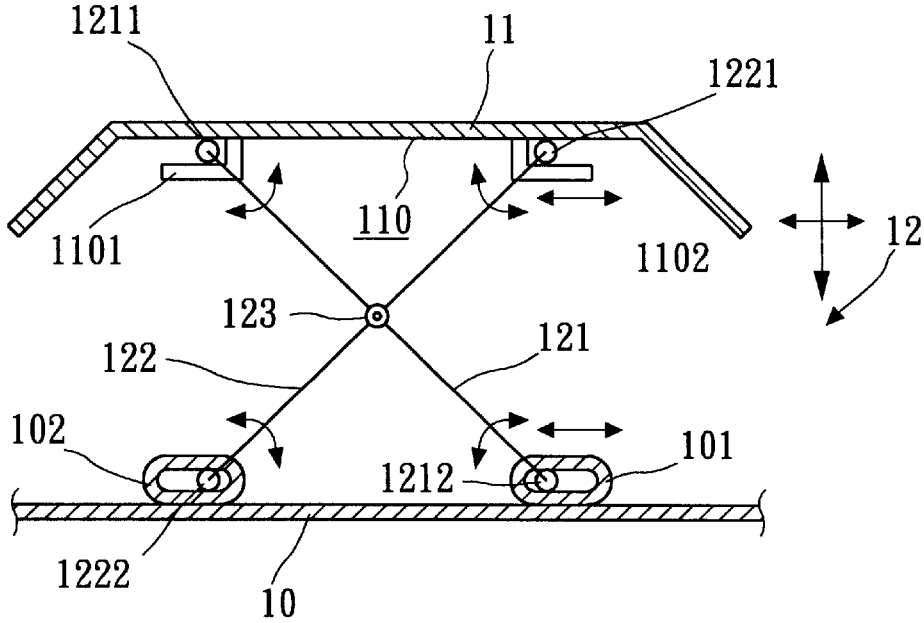
FIG. 3 (PRIOR ART)
FIG. 3 is a schematic side view of a further conventional collapsible key structure.
Figure 4:
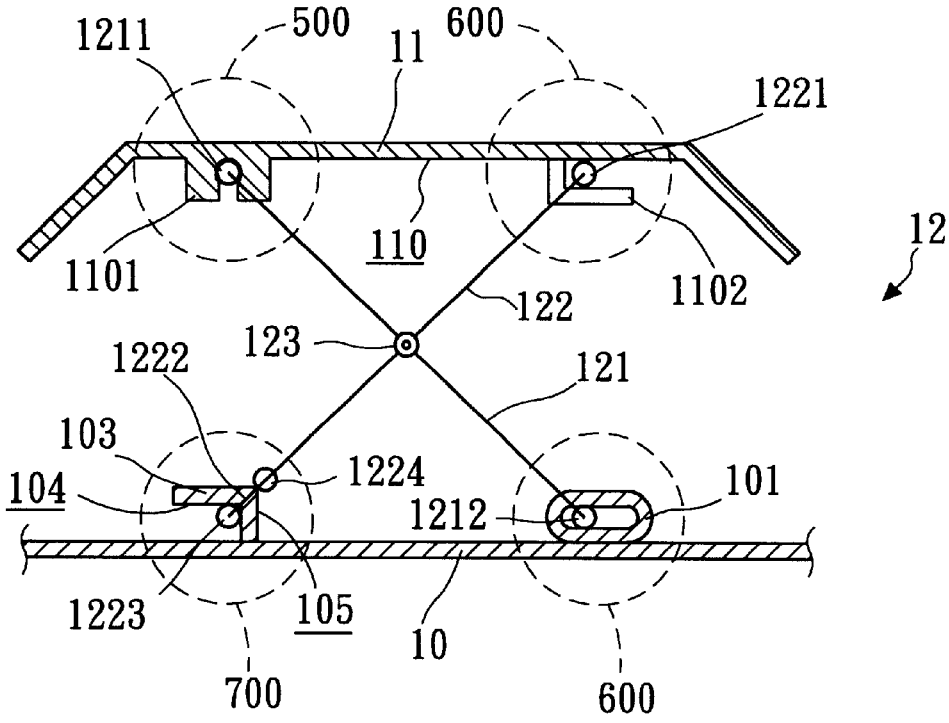
FIG. 4 is a schematic side view of a first embodiment of the collapsible key structure in accordance with this invention.

Referring to now FIG. 4, the collapsible key structure of this invention can be mostly constructed like the one shown in FIG. 2 except for the fourth hub 102 and the second bottom end 1222. The key structure includes a key top 11, a base plate 10, and two pairs of scissors type linkage 12 formed on the base plate 10 for supporting the key top 11 to move steadily upward or downward when external force applied upon the key top 11.

Figure 7B:
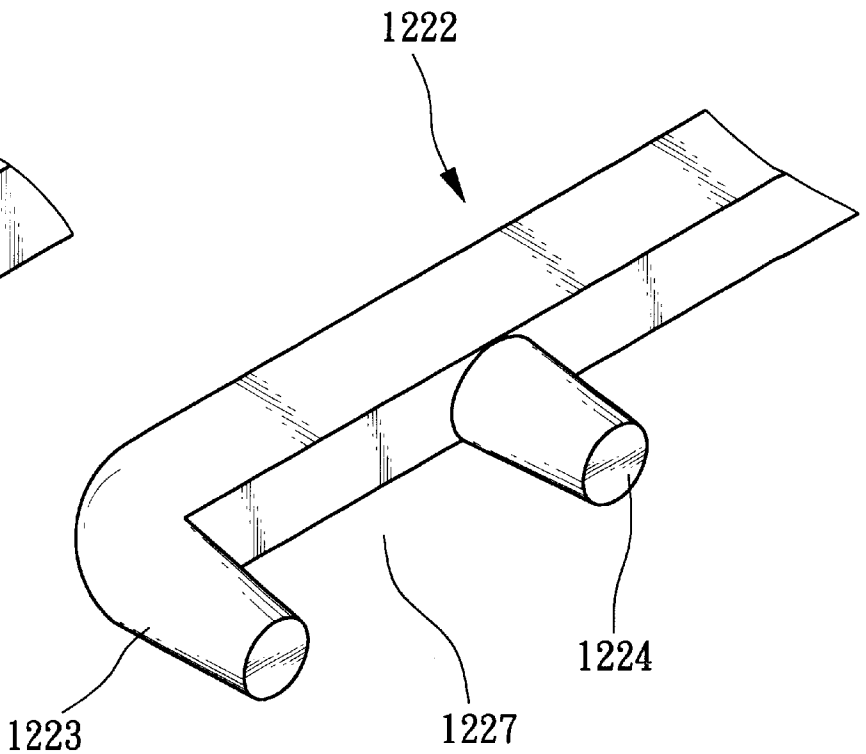
FIG. 7B is a fragmentary perspective view of another embodiment of the second bottom end in accordance with this invention.

Like the one shown in FIG. 2, the collapsible key structure has a first lever 121 with the first top end 1211 and the first bottom end 1212. The first top end 1211 is pivotally engaged with the first hub 1101 located under the bottom surface 110 of the key top 11 to form a pivotal connection 500, and the first button end 1212 is rotatably and slidably received in the third hub 101 located on the base plate 10 to form a rotatable and slidable connection 600. The second lever 122 is pivotally engaged with the first lever 121 at a pivotal point 123 formed in the middle of the first lever 121. The second lever 122 also has a second top end 1221 rotatable and slidable within the L-shaped second flange 1102 formed on the bottom surface 110 to form a rotatable and slidable connection 600. The second bottom end 1222 as shown has a first engaging pin 1223 and a second engaging pin 1224 (as shown in FIG. 7B). In this embodiment, the L-shaped bordering rail 103 is mounted on the base plate 10 to form a rotatable and slidable constraint means 700, and the second bottom end 1222 is rotatable and slidable under the bordering rail 103.

The bordering rail 103 has a substantially horizontally extending smooth first sliding surface 104 facing the base plate 10, and a substantially vertically extending smooth second sliding surface 105 facing the pivotal point 123. According to the present invention, the second sliding surface 105 may be curvedly shaped with a curvature. When the radius of the curvature is infinite, the second sliding surface 105 becomes a flat surface.

As shown in FIG. 4, the first engaging pin 1223 is formed at the bottom end of the second lever 122 and the second engaging pin 1224 is formed between the pivotal point 123 and the bottom end 1222 of the second lever 122. The second engaging pin 1223 is also spaced from the first engaging pin 1223 to form a receiving slot 1227 therebetween.

Since the receiving slot 1227 is wider than the thickness of the bordering rail 103, the constraint means 700 is loosely received in the receiving slot 1227 formed on the first lever 121. When the key top 11 is pressed downward, the first engaging pin 1223 slides horizontally along the first sliding surface 104, and the second engaging pin 1224 slides vertically along the second sliding surface 105.

Figure 5:
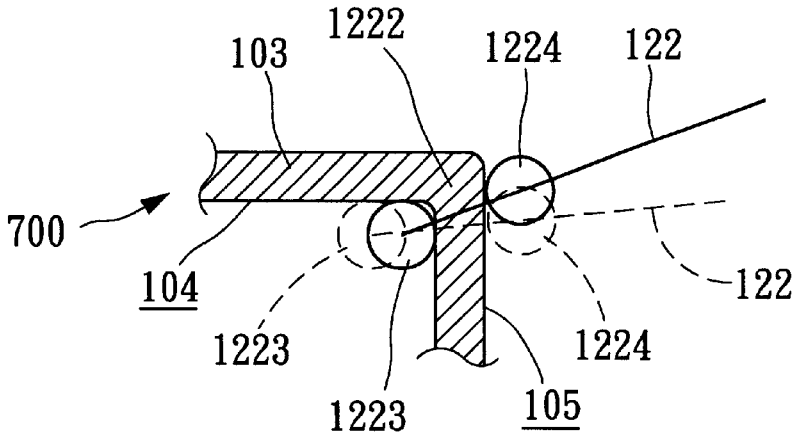
FIG. 5 is a fragmentary sectional view of the first embodiment for showing a bordering rail in detail.

Referring now to FIG. 5, when the depression key structure 11 is being depressed downward, the second lever 122 will be moved from the solid line to the broken line. Either or both of the first engaging pin 1223 and the second engaging pin 1224 will be respectively moved along and, at the same time, have substantial contact respectively with the first and the second sliding surfaces 104 and 105.

The bottom end 1222 thus serves as a rotatable and slidable point which may prevent the scissors type linkage 12 from moving sideward during the up and down movement of the depression key structure. Under such an arrangement, the movement of the depression key structure of the present invention is hence more stable than that of the conventional key structure described in the background section. The bordering rail 103 and engaging pins 1223 and 1224 of the present invention may be engaged or disengaged easily without much deforming the second lever 122 as that might happen to a fixed hub 102 shown in FIG. 2.

In FIG. 4, the bordering rail 103 is formed in a "L"-shaped. According to the present invention, the second sliding surface 105 may be (1) a flat smooth surface perpendicular to the first sliding surface 104 or (2) a curvedly shaped surface with certain angle relative to the first sliding surface 104. By changing the profile of the first and the second sliding surfaces 104 and 105, the distance between the first bottom end 1212 and the engaging pins 1223 and 1224 may be appropriately adjusted as well. Then, the vertical displacement of the key top 11 may also be changed, too. It may be done easily to suit various products without spending much upon varying molds or production lines that might otherwise be needed to meet the change of the fixed fourth hub 102 shown in FIG. 2 in the conventional structure.

Figure 6:
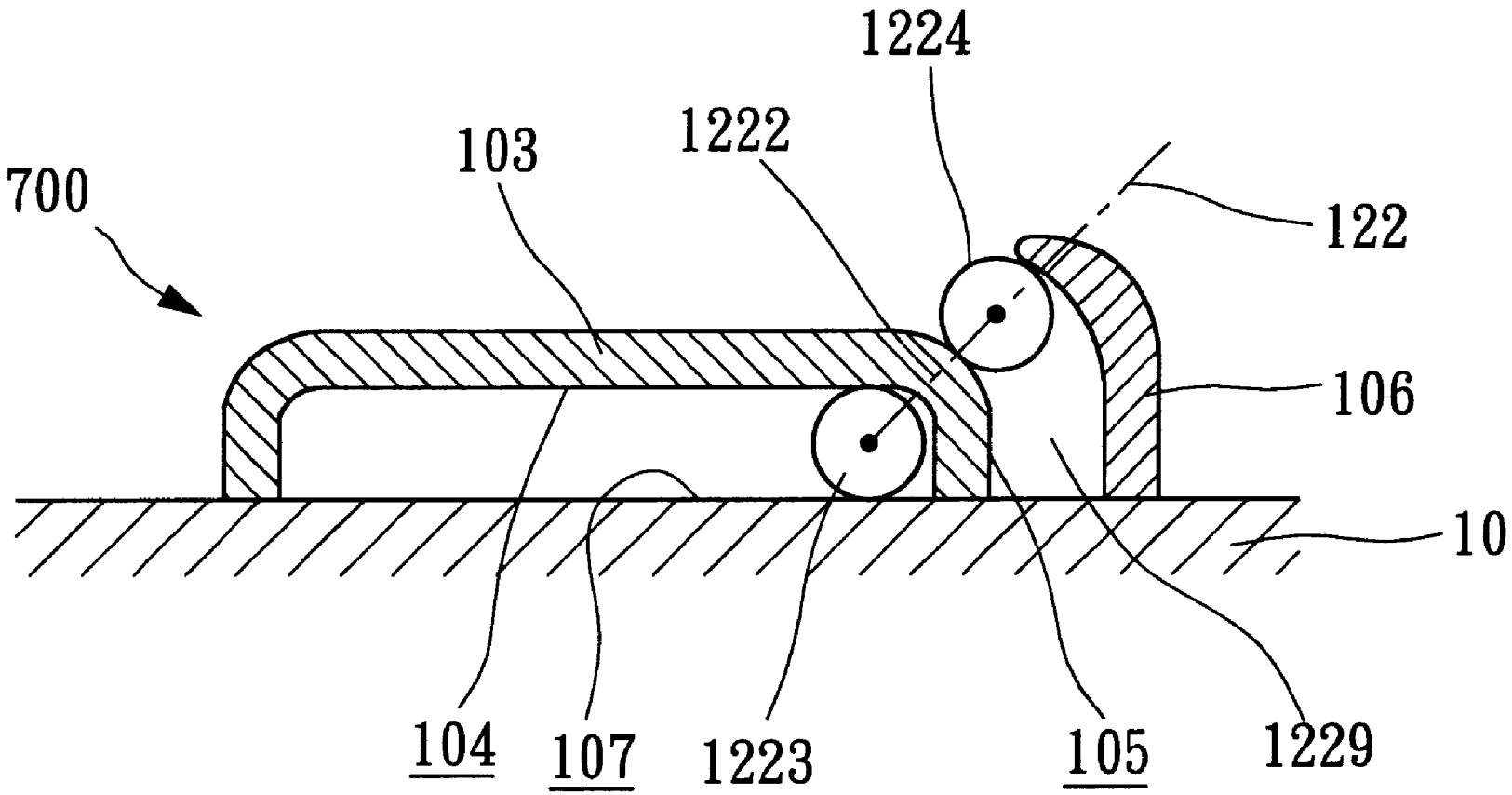
FIG. 6 is a fragmentary sectional view of a second embodiment of the collapsible key structure in accordance with this invention, for showing the bordering rail in detail.

FIG. 6 shows another embodiment of this invention, in which the bordering rail 103 is a rectangular member mounted on the base plate 10. As shown, the bordering rail

103 includes a horizontal smooth bottom surface serving as the first sliding surface 104 and a vertical smooth sidewall facing the pivotal point (not shown in the figure) serving as the second sliding surface 105. The corner of the rectangular member (i.e. the bordering rail 103) may have a fillet angle to smooth out the engaging pin movement.

FIG. 6 further shows yet another embodiment which has an auxiliary border member 106 mounted on the base plate 10 and spaced from the second sliding surface 105 to form the guiding slot 1229 therebetween. The second engaging pin 1224 slides within the guiding slot 1229.

The top surface of the base plate 10 close to the rectangular member (i.e. the bordering rail 13) may be smoothed to form a third slide surface 107 for coupling with the second sliding surface 105 to restrict the movement of the first engaging pin 1223.

All aforesaid structures may thus help to further restrain the moving of the scissors type linkage 12 and thereby the possibility of drifting sideward during the depression key structure moving up and down can be reduced to an acceptable degree.

In the present invention, the second sliding surface 105 may be a flat surface or a curved surface. The base plate 10 may be a simple flat board or a composite board consisting of different laminates such as the one disclosed in U.S. Pat. No. 5,463,195.

Figure 7A:
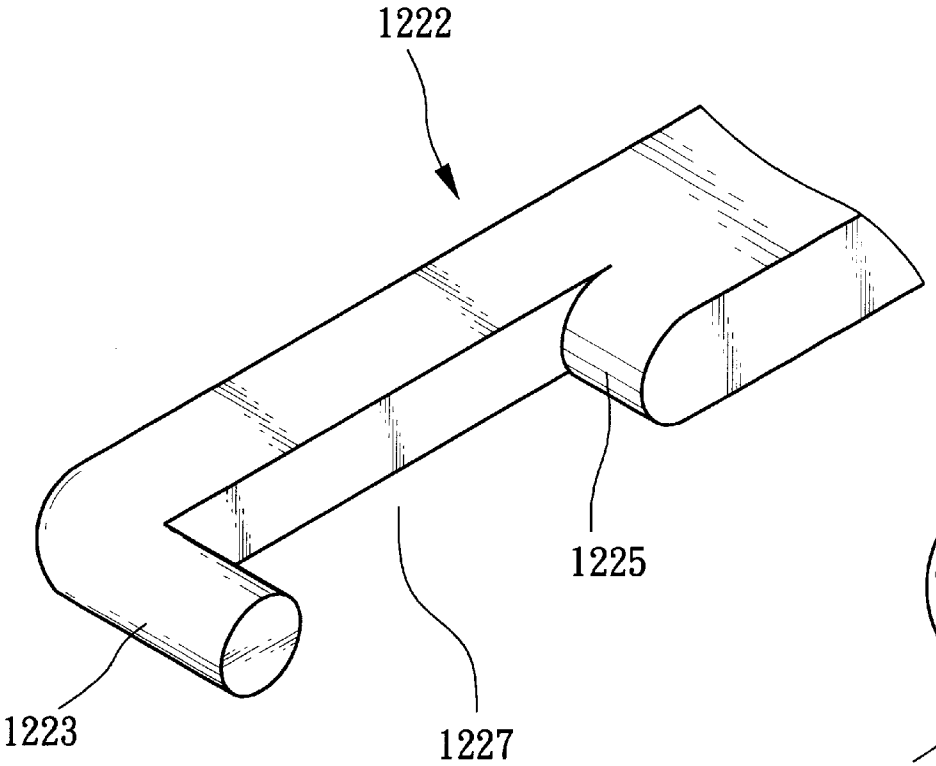
FIG. 7A is a fragmentary perspective view of a second bottom end in accordance with this invention.

While the embodiments of this invention set forth above have used the rotatable and slidable constraint means 700 to contain the bordering rail 103, engaging pins 1223 and 1224, and sliding surfaces 104 and 105, the pivotal connection 500 and the rotatable and slidable connection 600 shown in FIG. 4 may also be adapted as a rotatable and slidable constraint means when desired. The engaging pins 1223 and 1224 may be also made in the form of stubs, flanges or the like with one end attached to the second lever 122 and another free for wedging the bordering rail 103 from one edge thereof. FIG. 7A shows an embodiment in which the first engaging pin 1223 is embodied as a stub located at the tip of the second bottom end 1222 and the second engaging element 1225 forms a curved step end on the second lever. FIG. 7B, on the other hand, shows another embodiment with both the engaging pins 1223 and 1224 in stub forms.

Aforesaid embodiments of this invention use two pairs of the first and the second levers 121 and 122 to form two scissors type linkage so that there are four upper points to support the depression key structure and four lower points to mount on the base plate 10. The depression key structure thus may be supported securely and steadily even under repetitive hitting application. However, the two first bottom ends 1212 may be bound together. By the same token, the second bottom ends 1222 may also be bound together in some embodiments.

In summary, this invention enables the depression key structure to be moved up or down steadily within a confined track or path without drifting sideward. To assembly or disassembly the key structure is also simpler and easier without a lot of deformation upon the scissors levers, and thus makes production, repairs and maintenance more cost effective.

It may thus be seen that the objects of the present invention set forth herein, as well s those made apparent from the foregoing description, are efficiently attained. While the preferred embodiments of the invention have been set forth for purpose of the invention as well as other embodiments thereof may occur to those skilled in the art. Accordingly, the appended claims are intended to cover all embodiments which do not depart from the spirit and scope of the invention.

What is claimed is:

1. A key structure comprising:

a key top;

a base plate;

a scissors type linkage formed between the key top and the base plate for supporting the key top to move upward and downward relative to the base plate, the scissors type linkage comprising a first lever pivotally engaged with a second lever at a pivotal point formed on the first lever;

a first engaging pin formed at a bottom end of the first lever;

a second engaging pin formed between the pivotal point and the bottom end of the first lever, the second engaging pin being spaced from the first engaging pin to form a receiving slot therebetween; and a constraint means formed on the base plate to engage the bottom end of the first lever, the constraint means including a substantially horizontally extending first sliding surface facing the base plate and a substantially vertically extending second sliding surface facing the pivotal point, the constraint means being loosely received in the receiving slot formed on the first lever, wherein when the key top is pressed downward, the first engaging pin slides horizontally along the first sliding surface, and the second engaging pin slides vertically along the second sliding surface.

2. The key structure of claim 1 further comprising a substantially vertically extending auxiliary border member formed on the base plate and spaced from the second sliding surface to form a guiding slot therebetween, and the second engaging pin slideing within the guiding slot.

3. The key structure of claim 1, wherein the constraint means is a "L"-shaped flange comprising a vertical sidewall forming the second sliding surface and a horizontal arm forming the first sliding surface.

4. The key structure of claim 1, wherein the first sliding surface is flat and smooth.

5. The key structure of claim 1, wherein the second sliding surface is flat and smooth.

6. The key structure of claim 1, wherein the constraint means is a rectangular member comprising a vertical sidewall forming the second sliding surface and a horizontal wall spaced from the base plate serving as the first sliding surface.

7. The key structure of claim 1, wherein the scissors type linkage has two pairs of the first lever and the second lever.

* * * * *